United States Patent [19]

Pajonk et al.

[11] 4,365,944

[45] Dec. 28, 1982

[54] PLANT WITH A TUNDISH FOR PRODUCING METAL POWDER

[75] Inventors: Heinz Pajonk; Franz Höhne, both of Bruchköbel; Rolf Ruthardt, Hanau, all of Fed. Rep. of Germany

[73] Assignee: Leybold Heraeus GmbH, Cologne, Fed. Rep. of Germany

[21] Appl. No.: 276,772

[22] Filed: Jun. 24, 1981

[30] Foreign Application Priority Data

Jun. 30, 1980 [DE] Fed. Rep. of Germany ..... 3024709
Jun. 30, 1980 [DE] Fed. Rep. of Germany ..... 3024752

[51] Int. Cl.[3] ..... B22D 23/08

[52] U.S. Cl. ..... 425/7; 264/12; 266/207

[58] Field of Search ..... 266/207, 211, 208, 212, 266/143, 165; 164/253, 256, 258, 259; 75/0.5 C; 264/5, 12; 425/7

[56] References Cited

U.S. PATENT DOCUMENTS

| | | | |
|---|---|---|---|
| 3,334,408 | 8/1967 | Ayers | 29/420.5 |
| 3,554,268 | 1/1971 | Taylor et al. | 164/65 |
| 3,687,191 | 8/1972 | Hulit et al. | 164/258 |
| 3,785,633 | 1/1974 | Karlsson | 425/7 |

*Primary Examiner*—L. Dewayne Rutledge
*Assistant Examiner*—Christopher W. Brody
*Attorney, Agent, or Firm*—Felfe & Lynch

[57] ABSTRACT

A plant for producing metal powder from metal melts includes a first chamber with a device for converting a melt stream initially into liquid and then solid metal particles in a non-oxidizing atmosphere, a tundish with a closable floor opening that can be mounted on the first chamber and discharged thereinto, and a melt device for filling the tundish with molten metal. The metal melt is continuously protected against oxidation or absorption of gas, the structural height of the plant is reduced and the capacity of the melt device is utilized to a greater degree by enclosing the melt device by a second chamber separated from the first chamber for maintaining a nonoxidizing atmosphere. The second chamber is equipped with at least one lock into which the tundish can be brought and from which it can be removed. The tundish, formed as a transporting vessel, is provided with a cover for maintaining a non-oxidizing atmosphere during transportation and discharge into the first chamber and the second chamber of the melt device is equipped with a drive mechanism for raising the cover for the filling procedure of the tundish.

9 Claims, 3 Drawing Figures

PLANT WITH A TUNDISH FOR PRODUCING METAL POWDER

BACKGROUND OF THE INVENTION

The present invention relates to a plant for producing metal powder from metal melts, the plant containing a first chamber with a device for converting a melt stream initially into liquid and then solid metal particles in a non-oxidizing atmosphere, a tundish with a closable floor opening that can be mounted on the first chamber and emptied therein, as well as a melt device for filling the tundish with metal melt.

Such metal powder plants in which the tundish is permanently mounted on the powder production chamber and in which the melt device for filling the tundish is an open induction furnace, are known in the art. However, with such plants there is the danger of a partial oxidation of the melt by atmospheric oxygen, as well as an undesirable absorption of gas by the melt (German Offenlegungsschrift No. 24 59 131).

A vacuum induction melt plant with a lock device for the finished casting or ingot casting is known from German Auslegeschrift No. 1 041 652. The molds neither have a floor opening nor do they serve for transporting the metal melt to a metal powder plant. The molds do not have a cover and must therefore be cooled in a lock chamber until the melt has at least partially solidified. The molds also cannot be termed tundishes.

A vacuum device for producing finished castings and which in principle is identical to that of German Ausleseschrift No. 1 041 652 is also known from German Auslegeschrift No. 1 182 396. The molds serve neither for transporting the melt to a further processing plant, nor do they have a suitable closure means for which the mold contents can be protected against the influence of the atmosphere during transportation.

German Auslegeschrift No. 2 007 803 discloses an atomizing apparatus which is specially intended for atomizing aluminum. The melt device is not a vacuum or protective gas chamber, and it is also not provided with a lock device. Instead, the molten aluminum is run off via an open channel into a likewise open transporting vessel which transports the melt to an atomizing apparatus in which it is atomized under a protective gas.

The prior art also includes metal powder plants in which a further gas-tight chamber containing the tundish and the melt device is arranged directly on the powder production chamber, so that a protective atmosphere can be maintained both in the region of the melt device and also in the powder production chamber (German Offenlegungsschrift No. 15 58 370 and German Offenlegungsschrift No. 23 08 061). Such metal powder plants have, however, a considerable structural height, since it has to be remembered that the chamber for producing the metal powder has itself large dimensions, governed by the falling velocity of the metal particles and by the falling velocity of the metal particles and by the necessary residence time up to the solidification of the particles. As a rule such chambers are in the form of towers or slender vertical cylinders with conical ends. Furthermore, such plants are uneconomic in operation since the melt capacity of the melt device is substantially larger than the capacity of the associated chamber for producing the metal powder.

Finally, the prior art also includes metal powder plants in which rod-shaped starting material is continuously melted and converted into droplets, which are for example atomized by means of a centrifugal disc (German Offenlegungsschrift No. 25 28 999). Such plants are preferably intended for high grade metals with extremely high purity requirements, however, they have a low efficiency due to the draining-melting process.

SUMMARY OF THE INVENTION

The object of the invention is to provide a plant for producing metal powder of the type having a first chamber with a device for converting a melt stream initially into liquid and then solid metal particles in a non-oxidizing atmosphere, a tundish with a closable floor opening that can be mounted on the first chamber and emptied thereinto, as well as a melt device for filling the tundish with metal melt in which the metal melt is constantly protected against oxidation and/or absorption of gas, which has a relatively low structural height, and in which the melt device can additionally be used to charge further chambers for producing metal powder.

These and other objects are achieved with the plant for producing metal powder according to the present invention, wherein (a) the melt device is surrounded by a second chamber for maintaining a non-oxidizing atmosphere, which is spatially separated from the first chamber, (b) the second chamber is provided with at least one lock into which the tundish can be brought and from which it can be removed, (c) the tundish, formed as a transporting vessel, is provided with a cover for maintaining a non-oxidizing atmosphere during transportation and discharging into the first chamber serving for the production of powder, and (d) the second chamber of the melt device is provided with drive means for raising the cover for the filling procedure of the tundish.

The structure of the invention has the advantage that the chamber for producing the metal powder and the melt device are disconnected, so that the melt device can also be used for other purposes, for example for charging at least one further chamber for producing metal powder. By virtue of the fact that the tundish is formed as a transporting vessel and not only as a type of "pouring funnel," and combined with the fact that it has a cover or devices for maintaining a non-oxidizing atmosphere, it is possible to protect the melt against oxidation and/or absorption of gas, even though it may be transported over a fairly long distance. At the same time, the structural height of the plant is considerably reduced, with the result that the construction costs for installing the plant are also reduced.

The present invention can be used in conjunction with all processes in which a continuous and discontinuous melt stream is decomposed into individual metal particles. Atomization methods in which the melt stream is broken up into very fine droplets by one or more gas jets are suitable, and include methods such as ultrasonic atomization methods and centrifugal methods in which the melt is atomized by centrifugal forces, etc.

The present invention works especially advantageously with a tundish which, according to a further embodiment of the invention, has a metal casing, a ceramics lining forming a crucible, and a first thermal insulation arranged between the crucible and casing, and that between the crucible and first thermal insulation there is arranged a ceramics intermediate layer with a plurality of vertical shafts open at the top and distributed around the periphery, but closed laterally, in which resistance heating elements are installed from about by means of insulation mounts, the lower heatable part of the elements being arranged at a distance from the shaft walls and their upper unheated part being enclosed by the insulation mounts.

The tundish serves as a transporting vessel. Such transporting vessels generally serve not only, as indicated by their name, for transporting the melt between the site of production and site of consumption of the melt, but also for storing the melt for a period of time determined by how long it takes to remove the melt from the vessel. The storage period may in this connection be considerable, especially if the outflow amount per unit time is small in relation to the melt supply. This state of affairs exists in particular when producing metal powder from the melt. Powder production from liquid metal by a multiplicity of methods and variants thereof similarly is known in the art, as is the requisite plant and equipment.

A prerequisite for the transportation and storage of the melt is the maintenance of a specific temperature profile until all the melt has been consumed. If all forms of subsequent heating are dispensed with, an initial over-heating of the melt is then necessary, which must be greater the poorer the insulating properties of the transporting vessel. However, overheating increases the danger of an increased absorption of gas, as well as exogenous inclusions and increased wear and tear of the vessel lining. It is therefore regular procedure to heat the transporting vessel.

Heating the arc electrodes means a considerable structural expenditure on the vessel cover and should in practice not be carried out in the case of transporting vessels provided with covers. Inductive heating of the melt is similarly difficult. It is simple to install and operate an external induction coil, but this requires a non-ferromagnetic casing for the vessel or at least field-permeable windows within the casing. An internal induction coil would lead to heat engineering problems, which would have to be solved by an intensive cooling with resultant high energy losses, as well as to insulation problems if it is intended to place the interior of the transporting vessel under a vacuum. Resistance heating with heating conductors embedded in the lining ot ceramics materials causes insulation problems since most of the ceramics materials that can be used for this purpose become increasingly electrically conducting at temperatures above 1000° C.

All heating equipment and heating methods used hitherto have the disadvantage that they do not have a sufficiently large heat storage capacity. This is a disadvantage insofar as transporting vessels cannot in general be connected to electrical power lines during transportation. In the case of metal melts which can be poured into the transportation vessel only under vacuum and/or protective gas, it is also generally impossible to electrically heat the transporting vessel in the filling station, which is generally located within a melt plant but which is accessible only via hoses. In such cases therefore only the period during which the transporting vessel is being emptied is available for heating purposes. For the remaining period of each cycle no further possibility of heating is available, and accordingly there is the danger that the molten metal and transporting vessel will cool down.

In contrast thereto, the invention starts from the fact that the lined crucible and the thermal insulation lying between the crucible and container casing are of normal dimensions. The ceramics intermediate layer is thus additionally present, and a plurality of resistance heating elements distributed around the periphery is arranged therein, contact between the heated part of the resistance elements and the intermediate layer being avoided. In this way a temperature maximum occurs at the site of the resistance heating element, and also the intermediate layer reaches a temperature which is above that of the metal melt and considerably above that of the metal casing. The temperature falls steeply outwardly from the intermediate layer towards the casing, an effect which is due to the suitably dimensioned thermal insulation. The temperature gradient from the intermediate layer through the lining and the crucible to the melt is considerably flatter on account of the better thermal conductivity of the relevant structural parts. The thermal energy thus flows from the intermediate layer with the heating elements to the metal melt, and not in the reverse direction. In this connection, the intermediate layer has the function of a hollow cylindrical heat store, particularly if it consists of a ceramics material having a high specific heat. The storage capacity per unit volume can in addition be increased still further if a material of high density is used. High temperature brick material for load-bearing constructions as well as highly refractory insulating bricks having the required properties are readily commercially available.

The available storage volume is increased and the thermal transmission to the crucible is improved by mounting the resistance heating elements in laterally closed shafts, in contrast for example to the known procedure of mounting resistance heating elements in so-called nitches or recesses. The cylindrical internal surface of the intermediate layer also facilitiates the renewal of the lining, which has to be carried out at specified intervals. Insulation problems are avoided by the gap on all sides between the heating elements and the shaft walls. By heating the metal melt during its consumption, its temperature can be kept at a substantially constant level. This is especially important in producing metal powder by a so-called gas atomization with a narrow distribution spectrum, since the amount of melt flowing out depends on its viscosity, and this in turn depends on the temperature. Particular attention should be paid to maintaining all the process parameters constant when producing a substantially homogeneous and uniform metal powder.

The tundish according to the invention is provided in particular for producing metal powders based on nickel alloys, which require a casting temperature of 1550° C. to 1650° C.

With regard to a narrow size distribution spectrum of the metal powder, it is especially advantageous to provide the cover of the transporting vessel with a gas connection for a compressed gas source. As the level in the vessel falls, the hydrostatic pressure at the floor or floor opening of the vessel can be compensated by suitably regulating the gas pressure above the melt, so that a constant amount of melt flows from the vessel per unit time.

Further advantageous features of the subject of the invention follow from the remaining disclosure.

Preferred embodiments of the present invention are described in more detail hereinafter with the aid of the attached drawings in which:

DETAILED DESCRIPTION OF THE INVENTION

Figure 1:
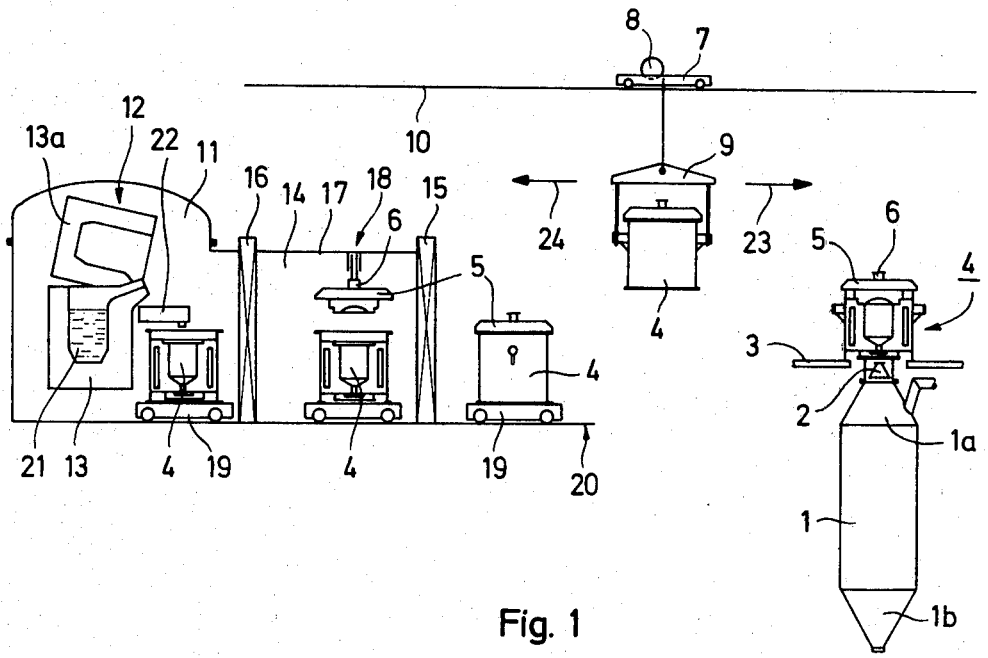
FIG. 1 is a diagrammatic representation of a complete plant according to the present invention for producing metal powder.

In FIG. 1 a first chamber 1 is shown, in which a device 2 for converting a melt stream into metal particles is arranged. In the present case this is a device for compressed gas atomization. The chamber 1 has the shape of a slender cylinder with an upper conical part 1*a* and a lower conical part 1*b*, in which the metal powder is collected. A non-oxidizing atmosphere can be produced in the chamber 1 either by means of a protective gas or by means of a vacuum pump. The first chamber 1 extends downwardly from a reference platform 3.

A tundish 4, which is designed as a transporting vessel and can be connected in a vacuum-tight manner to the upper end of the chamber 1, is mechanically supported on the reference platform 3. The tundish 4 has a cover 5 with a manipulating cone 6. At the point of connection of the chamber 1 and tundish 4, the latter has a closable floor opening (FIG. 2), by means of which a fine metal jet can be discharged coaxially into the chamber 1. Details of the atomization and solidification procedures are known in the art, and therefore need not be discussed in more detail here.

The tundish 4 can be raised and driven horizontally on the rails 10 by means of a crane carriage 7 and a cable winch 8 arranged thereon and a harness 9. The rails 10 run from the first chamber 1 to a second chamber 11, in which a melt device 12 is arranged. The latter consists of an inductively heated tipping crucible 13 which can be tipped from its melt position to the pouring position 13*a*. A non-oxidizing atmosphere can be created in the second chamber 11 as well, either by protective gas and/or vacuum.

The second chamber 11 is equipped with a lock 14 provided at both ends with lock valves 15 and 16. Drive means 18 in the form of a manipulator for raising the cover 5 for the filling procedure of the tundish 4 is located on the roof 17 of the lock 14.

For transportation through the lock valves 15 and 16 into the second chamber 11 and back, the tundish 4 is mounted on a transporting carriage 19 which can be driven on rails 20 into the chamber 11.

The operation of the afore-described plant is as follows: a predetermined portion 21 of a metal or an alloy is first of all melted in the tipping crucible 13. A tundish 4 is then driven by means of the transporting carriage 9 and after being suitably preheated, into the lock 14, which is thereupon evacuated. The cover 5 is then raised by means of the drive means 18 (manipulator), and the tundish 4 enters the chamber 11 after the lock valve 16 has been opened. The tipping crucible 13 is next brought into the position 13*a* and the tundish 4 is filled with the melt. A pouring chute 22 is provided to facilitate the pouring procedure.

After the filling procedure, the tundish 4 is transported back to the lock 14, in which the cover 5 is placed on top of the tundish 4. Once the lock valve 16 has been closed, the lock 14 has been flooded, and the lock valve 15 has been opened, the tundish 4 can then be brought out again into the open, where it is next taken by the crane carriage 7 by means of the harness 9 and transported in the direction of the arrow 23 to the first chamber 1. After emptying the tundish and converting the metal melt into metal powder, the tundish 4 is then transported back in the direction of the arrow 24 to the melt device 12, where the whole operation is repeated.

Figure 2:
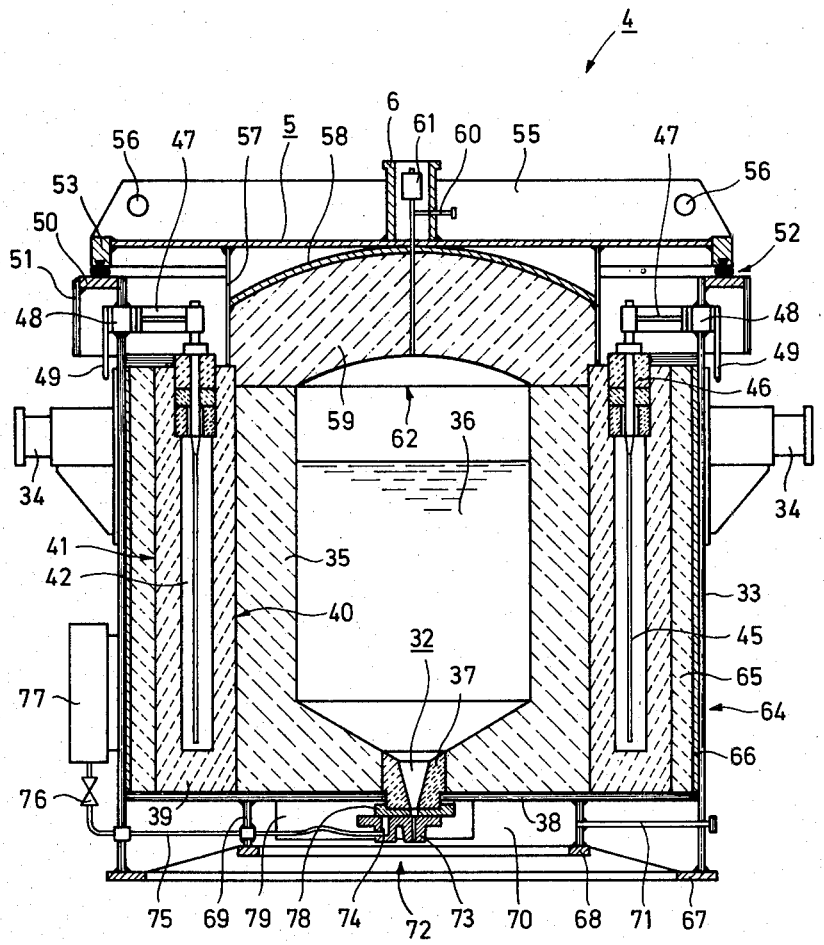
FIG. 2 is a vertical section through a tundish with a melt feed according to the present invention.

FIG. 2 shows the tundish 4 serving as a transporting vessel, and tundish being provided with a closable floor opening 32. The tundish 4 has a substantially rotationally symmetrical cross-section, i.e. the boundary surfaces and contact surfaces of all essential structural parts are formed as conical or cylindrical surfaces and also as annular surfaces, which are aligned concentrically to an imaginary vertical axis. A crucible 35 which is produced by a lining and contains a metal melt 36, is arranged in a cylindrical casing 33 made of steel sheet and having two diametrically located trunnions 34. The crucible 35 consists of bricks of high grade aluminum oxide or magnesium oxide and has at the bottom a floor opening 32 formed by a conical recess in a perforated brick 37. The crucible 35 rests on a base plate 38 penetrated only by a tapered extension of the perforated brick 37.

Figure 3:
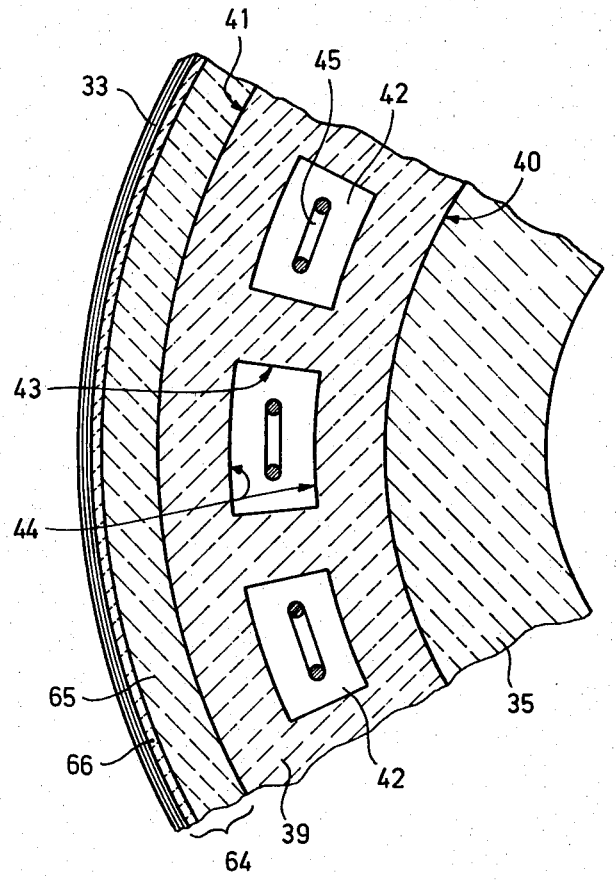
FIG. 3 is an enlarged portion from a horizontal section midway through the tundish of FIG. 2.

The crucible 35 is surrounded first of all by an intermediate layer 39, which is likewise constructed of individual highly refractory bricks, and whose vertical boundary surfaces 40 and 41 are cylindrical surfaces. A plurality of vertical shafts 42 of approximately square cross-section closed on all sides as well as at the bottom are located centrally within the interior of the intermediate layer 39 and distributed equidistantly around the circumference thereof. More accurately, the shaft walls 43 lie in radial planes and the shaft walls 44 in concentric cylindrical surfaces as is shown in FIG. 3.

An equal number of resistance heating elements 45 in the shape of a hairpin and inserted at their upper, thickened ends in insulation mounts 46, are located in the shafts 42. An upper, essentially unheatable part is formed by the thickening, whereas the remaining part of the resistance heating element can be heated to white heat. Such resistance heating elements are listed in commercial catalogues and are thus well known in the art. From FIGS. 2 and 3 it can be seen that the resistance heating elements 45 are on all sides spaced a sufficient distance from the shaft walls 43 and 44. The resistance heating elements are installed from above, by means of the insulation mounts 46, in the shafts 42 somewhat widened at this point.

The outer ends of the resistance heating elements 45 are led outwardly in an insulated manner through the casing 33 via radial supply lines 47 and vacuum lead-through 48. From there, connecting leads 49 lead to the power supply. The casing 33 has at its upper end an annular flange 50, from which a cylindrical protective collar 51 for the vacuum lead-throughs 48 extends downwardly.

The cover 5, which is provided with stiffening ribs 55 in which lifting eyes 56 are arranged, rests over a seal 52 and cover flange 53 on the annular flange 50. A cylindrical collar 57 and a cap 58, which are lined with a second thermal insulation 59 of ceramics material, are located beneath the cover 5. A gas connection 60 passes through the cover 5 and leads to a compressed gas source (argon), which is not shown. By means of the compressed gas the level of the metal melt 36 can be controlled and subjected to a pressure sufficient to compensate the reduction in the hydrostatic pressure when the melt level falls. An excess pressure valve 61 enclosed by the hollow manipulating cone 6 is located in a branch of the gas connection 60.

The second thermal insulation 59 projects slightly downwardly into the intermediate layer 39 and comes into direct contact with the upper annular shaped boundary surface 62 of the crucible 35. The intermediate layer 39 is enclosed by a first thermal insulation 64 consisting of an external lining 65 of thermally insulating ceramics material as well as of a thermally insulating fiber plate 66, made for example of kaolin wool, which is bent into a hollow cylinder. In this way a good thermal insulation of the intermediate layer 39 with respect to the casing 33 is achieved.

The casing 33 is provided at its lower edge with a supporting flange 67 by means of which the tundish 4 can be mounted on a base. A sealing flange 68 is arranged concentrically within the supporting flange and displaced upwardly with respect to the latter, and is secured in a vacuum-tight manner to the lower edge of a cylindrical collar 69. The sealing flange 68 and collar 69 enclose a space 70 which can be evacuated via a line 71 when the transporting vessel is mounted on a suitable sealing surface, for example on the sealing flange of the metal powder plant.

The floor opening 32 opens out into the space 70 via a sliding valve 72, shown only diagrammatically, which is provided with a calibrated outlet opening 73 for the melt to be atomized, and with an inlet opening 74 for a flushing gas. In the illustrated end position of the sliding valve 72 the outlet opening 73 is connected to the floor opening 32 so that the melt can flow out in an accurately metered manner. The inlet opening 74 is closed at one position of the valve. The opening 74 is connected via a line 75 and a valve 76 to a flushing gas source 77 (argon), which is detachably connected to the tundish 4 and is transported with the latter, so that a stream of flushing gas can be maintained through the inlet opening 74 into the crucible 35 when the sliding valve 72 has been moved to the right and is in the closed position. In this position the inlet opening 74 is in alignment with the floor opening 32, so that the latter can be kept free by the flushing gas stream from any melt tending to solidify. A perforated plate 78 serving as an abutment for the sliding valve 72 is also located between the sliding valve 72 and the perforated brick 37 with the floor opening 32. The whole sliding valve arrangement is enclosed by a sliding valve housing 79, likewise illustrated only diagrammatically.

What is claimed is:

1. In a plant for producing metal powder from metal melts, having a first chamber with means for converting a melt stream initially into liquid and then solid metal particles in a non-oxidizing atmosphere, a tundish with a closable floor opening and mountable on the first chamber for emptying thereinto and means for filling the tundish with metal melt, the improvement comprising: the tundish comprising a transporting vessel having a removable cover for maintaining a non-oxidizing atmosphere therein during transportation and discharge into the first chamber and means forming a second chamber spaced apart from the first chamber and enclosing the filling means for maintaining a non-oxidizing atmosphere, the means forming the second chamber comprising at least one lock into which the tundish can be brought and from which it can be removed and drive means for raising the cover for the filling procedure of the tundish.

2. The plant for producing metal powder according to claim 1, wherein the drive means is arranged in the lock.

3. The plant according to claim 1, wherein the tundish vessel comprises a metal casing, a ceramic lining forming a crucible, first thermal insulation arranged between the crucible and casing a ceramic intermediate layer between the insulation and the lining having a plurality of laterally closed vertical shafts open at the top and distributed around the periphery, resistance heating elements inserted in the shafts through the open ends and having heatable lower parts and unheated upper parts and insulation mounts attached to the shafts at the open ends thereof for mounting the elements with their lower heatable parts disposed at a distance from the shaft walls and enclosing the upper unheated part.

4. The plant according to claim 3, wherein the intermediate layer of the tundish comprises the same material as the crucible.

5. The plant according to claim 3, further comprising gas connection in the tundish cover for a flushing gas source.

6. The plant according to claim 3, further comprising a flushing gas source fixed on the tundish.

7. The plant according to claim 3 or claim 6, wherein the tundish has a sliding valve for opening and closing the floor opening comprising means forming an outlet opening for the melt and an inlet opening for a flushing gas, wherein in one end position of the sliding valve the outlet opening for the melt communicates with the interior of the crucible and in the other end position of the slide valve the inlet opening for the flushing gas is in communication with the interior of the crucible.

8. The plant according to claim 3, wherein the metal casing of the tundish has an external supporting flange at the bottom and an inner sealing flange displaced upwardly with respect to the supporting flange, for mounting the tundish in a gas-tight manner on a complementary sealing flange of the first chamber.

9. The plant according to claim 8, wherein the sealing flange of the tundish encloses the floor opening and the tundish further comprises means for evacuating the space within the sealing flange.

* * * * *